US007306687B2

(12) United States Patent
Fyfe

(10) Patent No.: US 7,306,687 B2
(45) Date of Patent: Dec. 11, 2007

(54) METHOD FOR REPAIRING STEEL-REINFORCED CONCRETE STRUCTURE

(76) Inventor: Edward R. Fyfe, 6310 Nancy Ridge Rd., Suite 103, San Diego, CA (US) 92121-3209

( * ) Notice: Subject to any disclaimer, the term of this patent is extended or adjusted under 35 U.S.C. 154(b) by 250 days.

(21) Appl. No.: 10/945,346

(22) Filed: Sep. 20, 2004

(65) Prior Publication Data

US 2006/0060286 A1 Mar. 23, 2006

(51) Int. Cl.
*B29C 73/00* (2006.01)

(52) U.S. Cl. ..... 156/94; 156/98; 264/36.1; 264/36.18; 264/36.19; 264/36.2

(58) Field of Classification Search ..... None
See application file for complete search history.

(56) References Cited

U.S. PATENT DOCUMENTS 3,260,661 A 7/1966 Kemp et al.
4,692,066 A 9/1987 Clear
4,699,703 A 10/1987 Norman
4,900,410 A 2/1990 Bennett et al.
5,292,411 A 3/1994 Bartholomew et al.
5,421,968 A 6/1995 Bennett et al.
5,650,060 A 7/1997 Huang et al.
5,657,595 A 8/1997 Fyfe et al.
5,714,045 A 2/1998 Lasa et al.
5,968,339 A * 10/1999 Clear ..... 205/730
6,303,017 B1 10/2001 Page et al.
6,572,760 B2 6/2003 Whitmore

FOREIGN PATENT DOCUMENTS

KR 2003088807 * 11/2003

* cited by examiner

*Primary Examiner*—Justin R. Fischer
(74) *Attorney, Agent, or Firm*—Palomar Patent; Mary Jo Redman; Calif Tervo

(57) ABSTRACT

A method for repairing concrete structural elements reinforced with steel rebar includes steps of: removal of debris and rust; attachment of expanded mesh zinc metal for sacrificial passive corrosion protection; and overwrapping with flexible panels of fiber-reinforced polymer composite material.

7 Claims, 1 Drawing Sheet

METHOD FOR REPAIRING STEEL-REINFORCED CONCRETE STRUCTURE

FIELD OF THE INVENTION

This invention relates generally to construction or repair of concrete structures, and more specifically to repair with inhibition of corrosion for steel-reinforced concrete.

BACKGROUND OF THE INVENTION

Most large concrete structures include a skeleton of welded steel rods for reinforcement. Because concrete is permeable by water, the steel rods eventually rust and corrode. The problem of corrosion of steel reinforcement is extreme in the case of a concrete column or similar structure that is partially submerged in seawater, such as a bridge piling; the salt ions aid corrosion and partial immersion in water helps drive electrochemical reactions, which are generally deleterious. Another significant source of corrosion of steel reinforcement is de-icing salt, which especially affects the deck of a bridge.

Corrosion of the steel is harmful to the structure. As the steel rods are dissolved or replaced by rust, they lose strength. Rust stains on the structure are ugly and may cause worry in persons using the structure. Corroded Steel has a greater volume than uncorroded steel; this expansion can crack the concrete and cause chunks to spall. Corrosion of the steel reinforcement can lead to eventual failure of the structure.

A widely used method of repairing cracked and spalled concrete structures, including bridge pilings, is to wrap structural elements in high-strength fiber-reinforced polymer composite panels. The wrap strengthens the structural element and partially shields it from further infiltration by water. A small amount of expansion of the steel due to residual corrosion slightly strengthens the composite wrap by putting it in tension. This method is discussed in more detail in U.S. Pat. No. 5,607,527, incorporated herein by reference.

In the case of structures in very corrosive environments, such as partly submerged in seawater, the composite wrap method does not protect the structure for as many years as is usually desired. Therefore, there is a need for a repair and protection method that has the many advantages of the composite wrap method, but that provides a longer reliable lifetime for structures in very corrosive environments.

SUMMARY OF THE INVENTION

The present invention is a method of repairing steel-reinforced concrete structures or structural elements that have been damaged by corrosion of the steel. The method is also useful for protecting structures that are not yet damaged but that are in potentially corrosive environments. The repair system includes perforated zinc metal, layers of ion transmitting medium, and panels of fiber-reinforced polymer composite.

According the method, cracked and spalled concrete is cleaned and patched with conventional patching material, such as epoxy or polymer-containing cementitious grout. Visible rust is cleaned by physical methods, such as sandblasting, or chemical cleaning, such as with an acid.

Portions of the cleaned steel reinforcement rod may be left uncovered by repair material and available for later electrical connection. Alternatively, reinforcement rod for electrical connection may be exposed by chipping away some of the overlying concrete.

A layer of zinc metal, preferably a perforated sheet or expanded mesh, is attached to the structure. Electrical connection is made between the reinforcement steel and the zinc metal, such as by welding or other type of connection that is reliable and provides for passage of a low-amperage current.

An ion transmitting medium is provided on both sides of the zinc metal. The ion transmitting medium allows completion of an electrochemical circuit between the steel and the zinc that is driven by the dissimilar electrode potentials of the metals. The small current that flows spontaneously (that is, without application of current from an external source) maintains the steel in a reduced state and inhibits its corrosion. Because electrons flow from the zinc to the steel, zinc ions are dissolved into the ion transmitting medium and the zinc is slowly consumed. Ion transmitting medium may be applied in the field or the zinc metal may have been previously coated on both sides with a suitable medium.

Then, the structure and attached zinc metal are wrapped in panels of fiber-reinforced polymer composite. The panels may be pieces of bias-cut textile that are dipped into a resin in the field and applied "wet." Alternatively, the panels may be pre-impregnated textile in a resin matrix that is "B-staged," that is, dry to the touch but not fully cross linked and cured. B-stage panels are attached to the structure with bolts or other mechanical fasteners. In either case, final cure of the polymer matrix occurs in ambient temperature.

B-stage panels may be attached to the zinc-covered structure such that a gap is left between the panels and the ion transmitting medium. The gap may be backfilled with a solidifiable fluid, such as cement or polymer-modified cementitious grout. The cement or grout protects the panels from puncture.

The invention will now be described in more particular detail with respect to the accompanying drawings in which like reference numerals refer to like parts throughout.

DETAILED DESCRIPTION OF THE INVENTION

Figure 1:
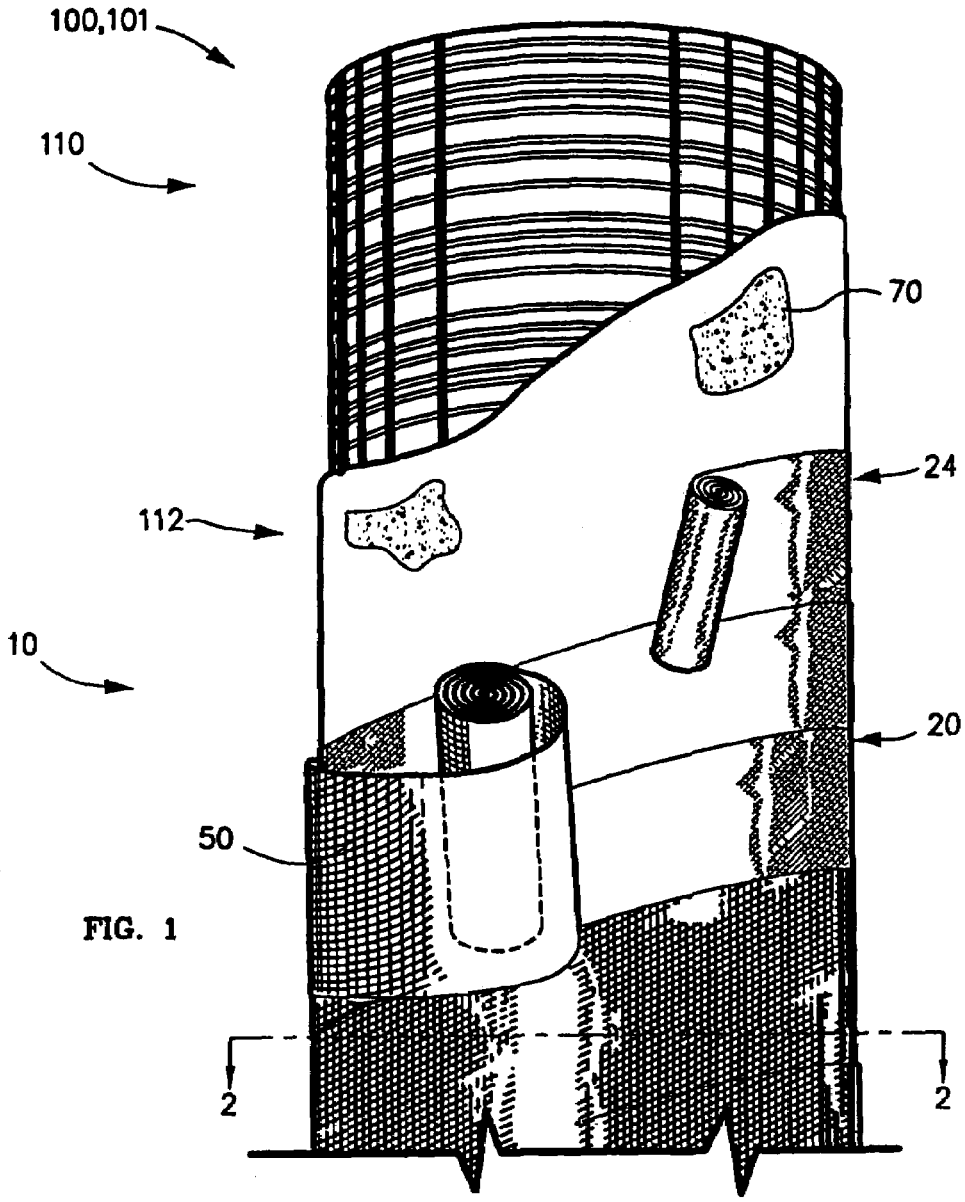
FIG. 1 is a stylized representation of the method of the present invention, showing successive steps of the method being performed along the height of a column under repair, beginning from the top.
Figure 2:
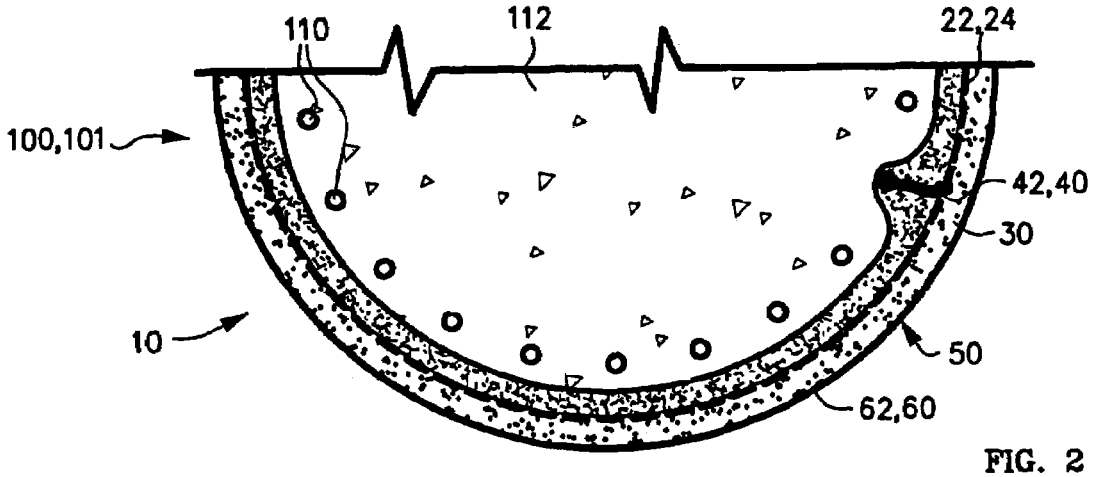
FIG. 2 is a cross-sectional view, partly cut away, of the repaired portion of the column of FIG. 1, taken on line 2-2.

The present invention is a method for repairing a steel-reinforced concrete structure or structural element 100, such as column 101, that has been damaged by corrosion of the steel rebar 110. FIG. 1 is a stylized representation of the method of the present invention, showing successive steps of the method being performed along the height of a column 101 under repair. FIG. 2 is a cross-sectional view, partly cut away, of the repaired portion of column 101 of FIG. 1, taken on line 2-2.

Column 101 may be a piling for a wharf or other partially submerged structure, or may be a structural element 100 of any other steel-reinforced concrete structure located in a potentially corrosive environment. Exemplary column 101 generally includes a skeleton of steel reinforcing rods 110, usually known as "rebar," that were welded or bolted together in the shape desired. Concrete 112 was molded or cast over the skeleton, embedding the rebar 110. Rebar 110 is for increasing the ductility of column 101 and helping join column 101 to other structural elements 100.

The repair system 10 includes zinc metal 20, one or more layers of ion transmitting medium 30, and panels of fiber-reinforced polymer composite 50. The method of the present invention is projected as providing corrosion protection to rebar 110 and mechanical protection or repair of structural element 100 for greater than fifteen years, if properly installed.

As discussed in the Background section above, water can penetrate concrete 112 and corrode rebar 110, especially in salty environments or in applications where column 101 is partly submerged in water. As rebar 110 corrodes, rebar 110 increases in volume and causes concrete 112 to crack and spall. After chunks of concrete 112 spall off, portions of rebar 110 may be directly exposed to the environment and corrosion accelerates. Repairing an area of damaged rebar 110 can cause accelerated corrosion of surrounding rebar 110, due to the repaired rebar 110 now being a "dissimilar metal" compared to the unrepaired portion. This well-known phenomenon is called "patch accelerated corrosion" or "repair-accelerated corrosion."

The present method of repair prevents repair-accelerated corrosion by including passive cathodic protection of rebar 110 by creating a galvanic couple with zinc metal 20, such as perforated zinc sheet 22, such as expanded mesh 24. Then the repaired column 101 with zinc metal 20 is provided long-term protection with an overwrap of a chemically neutral material, preferably a fiber-reinforced polymer composite.

To begin the repair method, any loose, crumbling concrete 112C is removed and any exposed and visibly corroded rebar 110C corroded is cleaned, by means well known in the art. Optionally, a chemical corrosion inhibitor, as known in the art, may be applied to the repaired rebar 110R. Voids in concrete 112C are filled with a repair compound 70 to restore the original outline of column 101, as is well known in the art. Repair compound 70 generally covers and re-embeds the cleaned, repaired rebar 110R.

At a later step of the method, it will be necessary to make an electrical connection to a portion of rebar 110. For this reason, a portion of repaired rebar 110R may be left unembedded by repair compound 70 at this point in the procedure.

The second phase of the repair is attachment of zinc metal 20, preferably perforated zinc sheet 22, such as expanded mesh 24, to the surface of repaired concrete 112R.

FIG. 1 depicts expanded mesh 24 being wrapped continuously around the surface of column 101. Expanded mesh 24 may be attached to the entire surface as shown, or alternatively may be wrapped only on the portion of column 101 that is normally located between low and high tide water levels, or may be attached only where potential corrosion is expected to be greatest. Zinc metal will be sacrificed to protect rebar 110 from corrosion, so the reliable lifetime of the repair performed according to the present method is proportional to the mass of zinc metal 20 used.

Expanded mesh 24 is mechanically and electrically attached to rebar 110 at several locations by connection 40, such as by welding, by connection by wire 42, or by mechanical fasteners such as bolts (not shown). The connection may be made to a portion of repaired rebar 110R, that was intentionally left non-embedded, as discussed above, or a different portion of rebar 110 may be exposed expressly for the purpose of making electrical connection, such as by chipping away a portion of concrete 112.

The present method can also be used to protect an undamaged structural element 100 from potential corrosion damage. In the case of an undamaged structural element 100, the first step of the method is exposure of portions of rebar 110 by removal of small areas of concrete 112, such as by chipping.

Connection 40 will form one leg of a circuit that will allow electrons to flow from expanded mesh 24 to rebar 110, especially to the iron atoms therein. Because of the dissimilar electrode potentials of the steel and zinc metals, a small current will flow spontaneously (that is, without application of current from an external source) through the circuit. Electrons will pass from the zinc to the steel of rebar 110 and help maintain the steel in a reduced, i.e., metallic, state. The zinc atoms of mesh 24 will be correspondingly oxidized; zinc ions will go into solution and the zinc metal will be gradually consumed.

To allow positive charge to flow in the opposite direction, completing the circuit, an ion transmitting medium 30 is included between the outer surface of concrete 112R and expanded mesh 24. Ion transmitting medium 30 may consist of any suitable material, such as gypsum grout 32 or open cell cellulosic foam, that is permeable by water and relatively large ions.

Although ion transmitting medium 30 is required only to be interposed between expanded mesh 24 and rebar 110, ion transmitting medium 30 is preferably applied on both the inner and outer surfaces of expanded mesh 24 so that the entire surface area of expanded mesh 24 participates in the sacrificial protection of rebar 110.

Ion transmitting medium 30 may be applied in various ways. For example, expanded mesh 24 may be precoated with ion transmitting medium 30, such as modified grout 32 or gel, on both sides. Alternatively, expanded mesh 24 can be provided as a laminate of mesh 24 between two sheets of flexible open cell foam (not shown) or other sheet-like ion transmitting medium 30. Alternatively, a layer of pasty gypsum grout 32 can be sprayed or troweled onto the surface of concrete 112, expanded mesh 24 attached over gypsum grout 32, then a second layer of gypsum grout 32 applied over the surface of expanded mesh 24 to completely cover expanded mesh 24.

According to a different preferred embodiment of the method of the invention, expanded mesh 24 may be attached to the outer surface of concrete 112 loosely, so as to leave a gap of about one centimeter between expanded mesh 24 and concrete 112. Then, a low-viscosity slurry of gypsum grout 32 is sprayed over expanded mesh 24 such that gypsum grout 62 flows between expanded mesh 24 and concrete 112, in addition to covering the outer surface of expanded mesh 24.

According to yet a different preferred embodiment of the method of the invention, ion transmitting medium 30 may be applied as the last step of the method, as will be discussed below.

Ion transmitting medium 30 typically includes small amounts of dissolved organic or inorganic salts, such as sodium chloride for enhanced conductivity or a fluoride salt for preventing passivation of zinc metal 20. Fluoride ion, for example, promotes even dissolution of the zinc metal and prevents buildup of poorly-soluble reaction products such as zinc hydroxide, which could disrupt the galvanic protection of rebar 110. Complexing agents such as EDTA salts can also function to prevent passivation by solvation of the dissolved zinc ions.

In the third phase of the repair method of the invention, panels or sheets of a suitable composite material 50, such as fiber-reinforced polymer (FRP) composite 52, are wrapped or otherwise attached over the surface of expanded mesh 24 and grout 32 to provide additional protection from seawater, waves, or mechanical damage such as from vandalism or collisions with boats.

FRP composite 52 is electrically insulating and prevent stray current from escaping the steel/zinc couple into the seawater. Preventing stray current is desirable because the current available for protection of rebar 110 is thus maximized.

Panels 50 may be prepared on-site by dipping sheets of fabric into a trough of a suitable resin and applied "wet," as disclosed in the patent noted in the Background section. The resin attaches panels 50 to the underlying expanded metal 24 and grout 32 by molecular adhesion both before and after the resin cures.

Alternatively, the panels may be pre-impregnated textile in a resin matrix that is "B-staged," that is, dry to the touch but not fully cross linked and cured. B-stage panels are attached to the structure with bolts or other mechanical fasteners. In either case, the polymer matrix cures in-situ at ambient temperature.

Typically, the textile portion of panel 50 is a woven fabric. Preferably, the fabric is cut on the bias such that the majority of the threads of which the fabric is woven are inclined at angles of 30 to 50 degrees relative to the length of panel 50.

An alternative preferred embodiment of the repair method, alluded to above, omits application of ion transmitting medium 30 at the time that expanded mesh 24 is attached to column 101. B-stage panels 54 are attached over expanded mesh 24 but not in contact with the entire surface of expanded mesh 24, such that a gap of up to a centimeter remains between most of the inside surface of panels 54 and most of the surface of expanded mesh 24. A solidifiable ion transmitting medium 60 such as grout 62 is poured, injected, or pumped into the gap until the empty volume is completely filled by grout 62.

In an application that requires more mechanical strengthening than panels 54 provide, an additional reinforcement sheet (not shown), such as a sheet of steel of an appropriate thickness, is optionally attached between ion transmitting medium 60 and panels 54.

The method of the present invention is not limited to steel-reinforced concrete structures. For example, the method is generally applicable also to structures that are primarily steel or iron.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A method for protecting a steel-reinforced structural member against corrosion of the steel; including the steps of:

providing an exposed portion of the steel reinforcement of the member for making electrical connection;

attaching a sheet of zinc metal to the surface of the member; including the sub-steps of:

applying a first coating of an ion transmitting medium to the surface of the member;

attaching a sheet of zinc metal over and in intimate contact with the coating; and applying a second coating of an ion transmitting medium over and in intimate contact with the sheet of zinc metal;

connecting an electrical path between the zinc metal and the exposed portion of the steel reinforcement; and attaching a panel of resin impregnated textile over the embedded zinc metal; and introducing a solidifiable fluid between the zinc metal and the panel of resin impregnated textile.

2. A method for repairing steel-reinforced concrete structural members that have been damaged by corrosion of the steel reinforcement, and for preventing additional corrosion damage; including the steps of:

cleaning away and repairing spalled or cracked concrete;

removing visible rust from steel reinforcement rods;

providing an exposed portion of the steel reinforcement of the member for making electrical connection;

attaching a sheet of perforated zinc metal to the surface of the member;

connecting an electrical path between the zinc metal and the exposed portion of the steel reinforcement; and attaching a panel of resin impregnated textile over the surface of the zinc metal such that a gap is formed between the panel of resin impregnated textile and the surface of the zinc metal; and backfilling the gap between the panel and the zinc metal by introducing a solidifiable fluid into the gap.

3. The method of claim 2, wherein the step of connecting an electrical path between the zinc metal and the exposed portion of the steel reinforcement includes the substeps of:

creating an electrically conductive, metallic connection between the zinc metal and the steel reinforcement; and embedding the zinc metal in an electrolyte such that ions may pass between the zinc metal and the steel reinforcement.

4. The method of claim 2, wherein the step of backfilling the gap includes introducing a solidifiable fluid such that the fluid penetrates the perforations of the perforated zinc metal and solidifies to become a solid electrolyte.

5. A method for protecting a steel-reinforced structural member against corrosion of the steel; including the steps of:

providing an exposed portion of the steel reinforcement of the member for making electrical connection;

providing a sheet of zinc metal coated on both faces with an ion transmitting medium;

attaching the sheet of coated zinc metal to the surface of the member;

connecting an electrical path between the zinc metal and the exposed portion of the steel reinforcement; and attaching a panel of resin impregnated textile over the embedded zinc metal; and introducing a solidifiable fluid between the zinc metal and the panel of resin impregnated textile.

6. The method of claim 5, wherein the step of backfilling the gap includes introducing a solidifiable fluid such that the fluid solidifies to become a solid electrolyte.

7. The method of claim 5, wherein the provided sheet of zinc metal is perforated.

* * * * *